United States Patent [19]

van Rijsewijk et al.

[11] Patent Number: 4,578,661

[45] Date of Patent: Mar. 25, 1986

[54] METHOD OF MANUFACTURING A CATHODE RAY TUBE AND DEVICE FOR CARRYING OUT THIS METHOD

[75] Inventors: Lambertus J. J. van Rijsewijk; Mario L. Thomas; Henricus J. J. C. Meijer; Ronald van der Wilk, all of Eindhoven, Netherlands

[73] Assignee: U.S. Philips Corporation, New York, N.Y.

[21] Appl. No.: 689,541

[22] Filed: Jan. 7, 1985

[30] Foreign Application Priority Data

Oct. 12, 1984 [NL] Netherlands ..... 8403112

[51] Int. Cl.[4] ..... H01F 7/00

[52] U.S. Cl. ..... 335/212; 335/284

[58] Field of Search ..... 335/210, 212, 213, 284

[56] References Cited

U.S. PATENT DOCUMENTS

| | | | |
|---|---|---|---|
| 3,375,389 | 3/1968 | Hughes | 335/212 |
| 4,138,628 | 2/1979 | Smith | 335/210 X |
| 4,162,470 | 7/1979 | Smith | 335/284 |
| 4,295,110 | 10/1981 | Uesaka et al. | 335/212 |
| 4,390,815 | 6/1983 | Key et al. | 335/210 X |

*Primary Examiner*—George Harris

*Attorney, Agent, or Firm*—Thomas A. Briody; William J. Streeter

[57] ABSTRACT

A method of manufacturing a cathode ray tube in which magnetic poles are provided in or around the neck (4) of the envelope (1) and around the paths of the electron beams extending substantially parallel to the axis (8) of the tube, said poles generating a permanent multipole magnetic field to correct the occurring errors of convergence and color purity and frame defects of the color display tube, which magnetic poles are formed by magnetizing a configuration (17) of magnetizable material which is provided around the paths of the electron beams, which configuration is magnetized by energizing a multipole coil unit (15) by means of a combination of currents with which a static multipole magnetic field is generated and the magnetization is produced by means of a decaying alternating magnetic field which is generated by means of an alternating field coil (16) and which initially drives the magnetizable material on both sides of the hysteresis curve into saturation. When the decaying alternating magnetic field is an axial magnetic field which is substantially parallel to the paths of the electron beams, much less crosstalk occurs in the radial coils (21 to 28) of the multipole coil unit (15) than when a radial alternating field is used and the effect of the stray field components is reduced. The driving of an axial alternating field coil (16) is much simpler than of a number of radial alternating field coils.

5 Claims, 7 Drawing Figures

Figure 1:
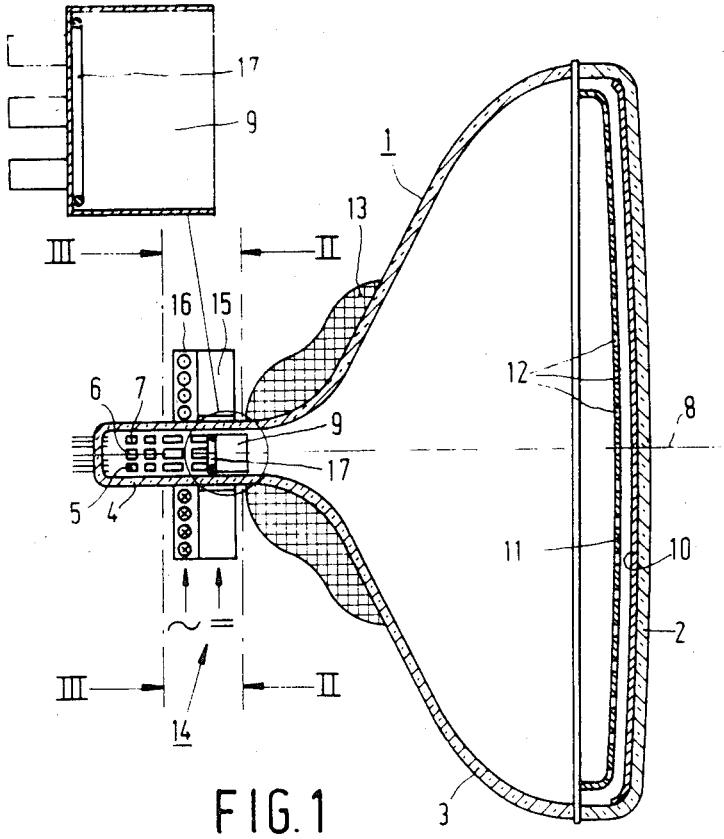

METHOD OF MANUFACTURING A CATHODE RAY TUBE AND DEVICE FOR CARRYING OUT THIS METHOD

The invention relates to a method of manufacturing a cathode ray tube in which at least one electron beam is generated by means of an electron gun system in the neck of the envelope and magnetic poles are provided around the said electron beam and generate a permanent multipole magnetic field, said poles being formed by magnetizing a configuration of magnetizable material provided around the electron beam, said configuration being magnetized by energizing, by means of a combination of currents, a multipole coil unit with which a static multipole magnetic field is generated and the magnetization is produced by means of a decaying alternating magnetic field which initially drives the magnetizable material on both sides of the hysteresis curve into saturation.

The invention also relates to a device for carrying out the method.

Such a cathode ray tube may be, for example, a colour display tube, a monochrome display tube or an oscilloscope tube.

Such a method and device are known from U.S. Pat. No. 4,220,897.

In a colour display tube of the "in-line" type, the three electron guns are arranged in the tube neck so that the axes of the three guns are situated substantially in one plane, while the axis of the central electron gun coincides substantially with the axis of the display tube. The two outer electron guns are situated symmetrically with respect to the central gun. In a colour display tube of the "delta" type, three electron guns are provided in a triangular arrangement in the tube neck. The points of intersection of the gun axes with a plane perpendicular to the tube axis constitute the corners of an equilateral triangle. As long as the electron beams generated by the electron guns are not deflected, the three electron beams, both in tubes of the "in-line" type and of the "delta" type—must converge (statically) in the centre of the display screen. Because, however, as a result of errors in the manufacture of the display tube, for example, a sealing of the electron guns not quite symmetrical with respect to the tube axis, deviations of the frame shape, the colour purity and the static convergence occur, it must be possible to correct said deviations.

Such a colour display tube of the "in-line" type in which this is the case is known from U.S. Pat. No. 4,211,960 which may be deemed to be incorporated herein. Said Specification discloses a colour display tube in which the said deviations can be corrected by magnetizing a ring of a magnetizable material, as a result of which a static magnetic multipole is fored around the paths of the electron beams. Said ring is provided in or around the tube neck. In the method described in U.S. Pat. No. 4,211,960 the colour display tube is operated after which data regarding the size and the direction of the convergence defects of the electron beams are established, with reference to which the polarity and the value of the magnetic multipole are determined which are necessary for the correction of the frame, colour purity and convergence defects. The magnetization of the configuration which may consist of a ring, a band, or a number of rods or blocks grouped around the electron paths, is done in the manner described in the opening paragraph in which a multipole is obtained by one total magnetization.

U.S. Pat. No. 4,424,466 which may be considered to be incorporated herein discloses an oscilloscope tube in which the ring of magnetizable material is used for correcting quite different defects. For example, the ring is connected between the first and second set of deflection plates, between the second set of deflection plates and the display screen, or between the cathode and the first set of deflection plates. More than one ring per tube may also be used and magnetized.

It is the object of the invention to improve the said method and to simplify the device required therefor.

According to the invention, an improved method of the kind described in the opening paragraph is characterized in that the decaying alternating magnetic field is an axial magnetic field which is substantially parallel to the electron beam or electron beams.

The invention is based inter alia on the recognition that the alternating field comprises stray field components. With the so far used radially directed alternating field these give rise to a small residual convergence error. Because the alternating field now is directed axially, hence in the direction of propagation of the electron beam, the effect of said stray field components is considerably less large. The requirements which are imposed upon the quality of the alternating field may hence be smaller. The magnetic field of the multipole coil unit of the magnetization device is usually directed radially, towards the tube axis or away therefrom. In the device described in U.S. Pat. No. 4,220,897 the alterating field was also directed radially, as a result of which an interfering crosstalk occurred in the coils of the multipole coil unit. A preferred method is hence characterized in that the magnetic alternating field is substantially perpendicular to the magnetic field of the multipole coil unit. The magnetic crosstalk is minimized thereby.

A device for carrying out the method according to the invention is characterized in that the said device comprises a multipole coil unit whose axes of the coils extend substantially radially from the tube axis, and at least one alternating field coil the axis of which substantially coincides with the tube axis.

The use of one or two axial coils is much simpler than of the so far usual, radially directed coil in which a more complicated drive was necessary to obtain a rotating magnetic field.

The alternating field coil may be provided inside or outside the multipole coil unit. The alternating field coil, however, viewed in the direction of propagation of the electron beam, may also be placed in front of or behind the multipole coil unit.

With a radially directed alternating magnetic field rotational forces were exerted on the electron gun and could adversely influence the positioning of the gun. Said influence does not occur any more when using the method according to the invention. What has been found indeed is that a smaller spread of the gun position in the tube does occur when the method is used.

Another advantage is that the magnetization unit can be constructed to be considerably smaller when an axially directed alternating field coil is used.

Figure 2:
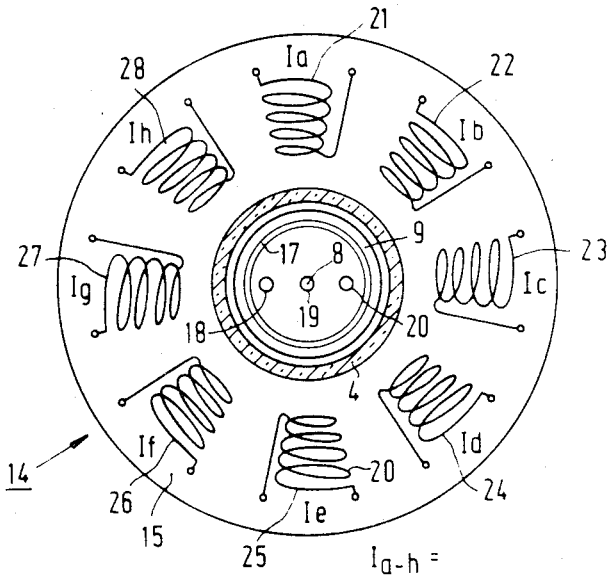
Figure 3:
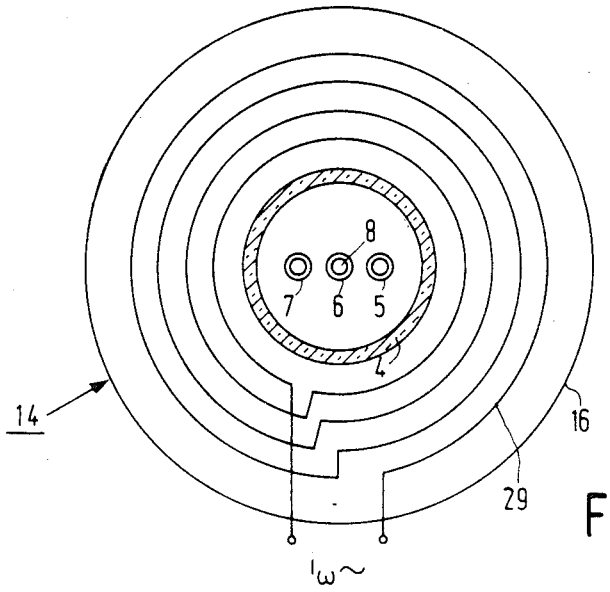

The invention will now be described in greater detail, by way of example, with reference to a drawing, in which FIG. 1 is a longitudinal sectional view of a colour display tube of the "in-line" type in a magnetization device according to the invention, FIG. 2 is a sectional view of FIG. 1, FIG. 3 is another sectional view of FIG. 1, and FIGS. 4*a, b, c* and *d* show other embodiments of the device according to the invention.

FIG. 1 is a diagrammatic sectional view of a known colour display tube of the "in-line" type. Three electron guns 5, 6 and 7 generating three electron beams are provided in the neck of a glass envelope 1 which is composed of a display window 2, a funnel-like part 3 and said neck 4. The axes of the electron guns are situated in one plane, the plane of the drawing. The axis of the central electron gun 6 coincides substantially with the tube axis 8. The three electron guns open into sleeve 9 which is situated coaxially in the neck 4. On its inside the display window 2 has a large number of triplets of phosphor lines. Each triplet comprises a line consisting of a green-luminescing phosphor, a line consisting of a blue-luminescing phosphor and a line consisting of a red-luminescing phosphor. All triplets together constitute the display screen 10. The phosphor lines are perpendicular to the plane of the drawing. The shadow mask 11 comprising a large number of elongate apertures 12 through which the electron beams pass is provided in front of the display screen. The electron beams are deflected by the system of deflection coils 13 in the horizontal direction (in the plane of the drawing) and in the vertical direction (at right angles thereto). The three electron guns are mounted so that the axes thereof enclose a small angle with each other. As a result of this the generated electron beams pass through the apertures 12 at the said angle, the so-called colour selection angle, and each impinge only on phosphor lines of one colour. A display tube has a good static convergence when the three electron beams, when not deflected, intersect each other substantially in the centre of the display screen. However, it has been found that the static convergence often is not good, nor are the field shape and the colour purity, which may be the result of an insufficiently accurate gun mounting and/or sealing of the electron guns in the neck of the tube.

For example, by magnetizing a configuration of magnetizable material, for example, a ring, so that it causes a correction field, the errors in the convergence, the colour purity and the frame of the displayed picture can be eliminated for the greater part. This is described elaborately in the said U.S. Pat. No. 4,220,897 which may be considered to be incorporated herein.

The magnetization device 14 comprises a multipole coil unit 15 and an alternating field coil 16. The device 14 is provided around a configuration of magnetizable material, in this case a ring 17 of an alloy of Fe, Co, V and Cr (known under the tradename Vicalloy) which is connected on the bottom of sleeve 9 around the electron beams. It will be obvious that the ring may also be provided at other places around the guns or in or around the tube neck. Instead of a ring it is also possible to use a band or a configuration of bars or blocks of magnetizable material.

FIG. 2 is a sectional view of FIG. 1. Sleeve 9 is present in the neck 4 and on the bottom is ring 17 which is placed around the electron beams 18, 19 and 20. The magnetization unit 14 of which the multipole coil unit 15 is shown, is provided around the tube neck 14. It comprises coils 21 to 28 for generating the desired multipole field. A multipole field is a combination of bipoles, quadrupoles, sixpoles and optionally multipoles. Dependent on the corrections to be carried out various true bipoles, quadrupoles, sixpoles and optionally higher order poles and combinations thereof can be generated by means of said multipole coil unit by passing through the coils 21 to 28, respectively, suitable direct currents (=) $I_a$ to $I_n$, respectively. The axes of the coils 21 to 28 extend radially from the tube axis 8. The magnetic fields generated by said coils are hence also directed radially.

FIG. 3 is another sectional view of FIG. 1. An alternating field coil 16 is placed against the multipole coil unit 15 around the guns 5, 6 and 7 (see FIG. 1). It comprises one coil 29 through which the decaying alternating current ( )$i_w$ flows with which the decaying alternating field is generated. During the magnetizing period the alternating current $i_w$ must be so large that the material of the ring on both sides of the hysteresis curve is magnetized into saturation completely. When the alternating field has decayed, the ring 17 is magnetized as a multipole. The multipole in the ring generated by the multipole coil unit is magnetized and the magnetizing unit can be removed. It will be obvious that, when the magnetization after one magnetization step is still not good, it may be repeated once or several times.

The magnetic alternating field is axial and directed substantially perpendicularly to the magnetic multipole field. The crosstalk of the alternating field in the coils of the multipole coil unit hence is minimum.

FIGS. 4*a* to 4*d* show, analogously to FIG. 1, alternative embodiments of magnetization devices according to the invention.

Figure 4:
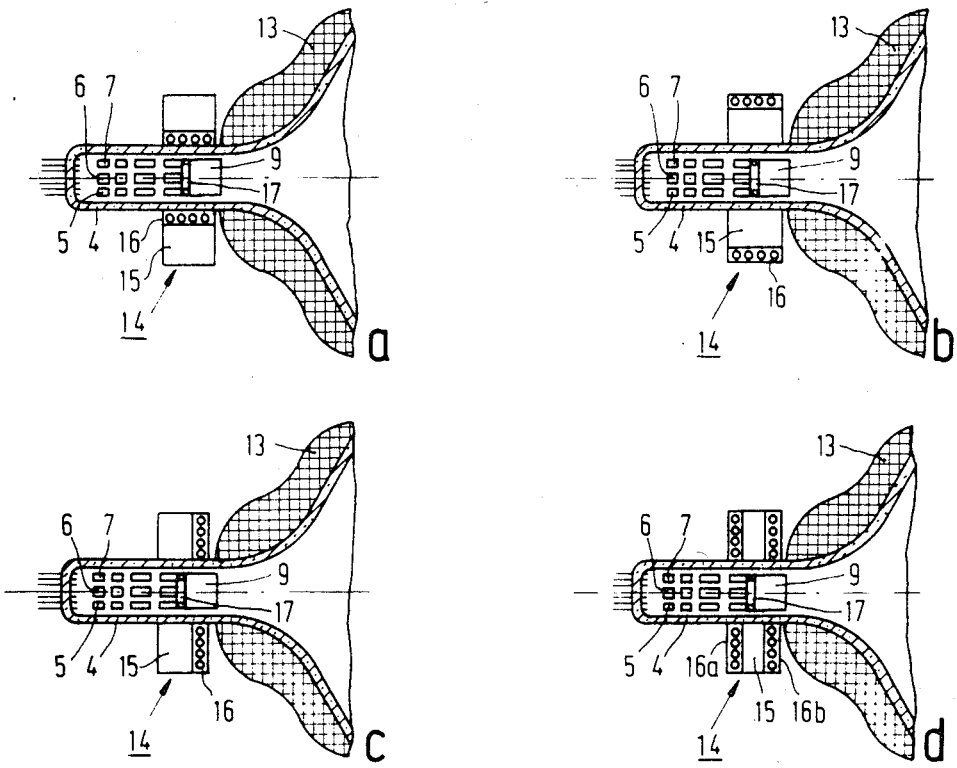

In FIG. 4*a* the alternating field coil is placed in the multipole coil unit 15.

In FIG. 4*b* the alternating field coil is placed around the multipole coil unit 5.

In FIG. 4*c* the alternating field coil is provided against the multipole coil unit 15 on the display screen side, and in FIG. 4*d* the alternating field coil is divided into two coil parts 16*a* and 16*b* which are placed against the multipole coil unit 15.

It is, of course, also possible to use combinations of the alternating field coils shown in FIGS. 4*a* to 4*d*. It is essential for the alternating field to be axial. The frequency of the alternating field may be 50 or 60 Hz, so that the alternating field coil or coils can be supplied directly from the mains. It is also possible, however, to use other frequencies.

The method has been explained with reference to a cross-section of a colour display tube. However, this method may also be used upon magnetizing a configuration of a magnetizable material (for example, a ring) in an oscilloscope tube as disclosed in U.S. Pat. No. 4,424,466, or in a monochrome display tube, for example, a D.G.D.-tube (Data Graphic Display) or a projection television display tube.

What is claimed is:

1. A method of manufacturing a cathode ray tube in which at least one electron beam is generated by means of an electron gun system in the neck of the envelope and magnetic poles are provided around the said electron beam and generate a permanent multipole magnetic field, said poles being formed by magnetizing a configuration of magnetizable material provided around the electron beam, said configuration being magnetized by energizing, by means of a combination of currents, a multipole coil unit with which a static multipole magnetic field is generated and the magnetization is produced by means of a decaying alternating magnetic field which initially drives the magnetizable material on both sides of the hysteresis curve into magnetization, characterized in that the decaying alternating magnetic field is an axial magnetic field which is substantially parallel to the electron beam or beams.

2. A method as claimed in claim 1, characterized in that the alternating magnetic field is substantially perpendicular to the magnetic field of the multipole coil unit.

3. A device for carrying out the method as claimed in any of the claims 1 or 2, characterized in that said device comprises a multipole coil unit the axes of the coils of which extend substantially radially from the tube axis, and at least one alternating field coil whose axis coincides substantially with the tube axis.

4. A device as claimed in claim 3, characterized in that the alternating field coil is provided inside or outside the multipole coil unit.

5. A device as claimed in claim 3, characterized in that the alternating field coil, viewed in the direction of propagation of the electron beam, is placed in front of and/or behind the multipole coil unit.

* * * * *